US006914527B2

(12) United States Patent
Hsu

(10) Patent No.: US 6,914,527 B2
(45) Date of Patent: Jul. 5, 2005

(54) INFRARED DETECTOR

(76) Inventor: Jui-Hung Hsu, No. 400, Chingnian Rd, Tainan (TW), 700

( * ) Notice: Subject to any disclaimer, the term of this patent is extended or adjusted under 35 U.S.C. 154(b) by 94 days.

(21) Appl. No.: 10/424,824

(22) Filed: Apr. 29, 2003

(65) Prior Publication Data

US 2004/0217863 A1 Nov. 4, 2004

(51) Int. Cl.[7] ..... G08B 13/18
(52) U.S. Cl. ..... 340/556; 250/221; 250/222.1
(58) Field of Search ..... 340/556, 555, 340/568.5; 250/221, 222.1

(56) References Cited

U.S. PATENT DOCUMENTS 5,218,196 A * 6/1993 Dogul et al. ..... 250/221
5,281,810 A * 1/1994 Fooks et al. ..... 250/221.1
5,936,522 A * 8/1999 Vogt ..... 340/545.1
6,433,684 B1 * 8/2002 Lie ..... 340/569
6,542,079 B1 * 4/2003 Kahl, Sr. ..... 340/568.5

* cited by examiner

*Primary Examiner*—John Tweel, Jr.
(74) *Attorney, Agent, or Firm*—Alan D. Kamrath; Nikolai & Mersereau, P.A.

(57) ABSTRACT

An infrared detector includes a light emitter and a light receiver. The light emitter has plural light emitting units. A circuit connects the light emitter with a CPU programmed decoder and a power amplifying controller. A special coded signal is amplified and emitted out with an infrared light beam by the light emitting units to a light receiver. The light receiver has plural infrared light receiving units. A circuit connects the receiving units with a signal amplifier, a CPU programmed calculating and comparing decoder, and an output controller. The special coded signal with the infrared light beam received by each separate infrared light receiving unit is simultaneously sent to the signal amplifier for amplifying and to the CPU programmed calculating and comparing decoder for processing and controlled by the output controller. Thus, the infrared detector is prevented from being disabled by an unauthorized code or a different code by an unauthorized person.

3 Claims, 4 Drawing Sheets

INFRARED DETECTOR

BACKGROUND OF THE INVENTION

1. Field of the Invention

This invention relates to an infrared detector, particularly to an infrared detector having high security to overcome disadvantages of a conventional infrared detector which is liable to be disabled and lose its function.

2. Description of the Prior Art

A conventional infrared detector generally includes a light emitter, and a light receiver combined together. In operation, the light emitter and the light receiver are positioned to face each other and are spaced apart with a preset distance within an effective scope. The light emitter emits an infrared light beam with a code, such as a lane-style protective light beam, to the light receiver. When, anyone such as a thief should walk through the gap between the light emitter and the light receiver to interrupt the infrared light beam from being received by the light receiver, a protective appliance such as a threatening lamp or an alarm may be automatically triggered to call attention to the interruption detected by the infrared detector. Many buildings use this kind of infrared detector for security. Further, conventional infrared detectors have a single-lane, a double-lane or a multi-lane light beam. The double-lane light beam infrared detectors are popularly used, as they can prevent false alarms caused by a falling leaf or the like The operation principle of double-lane light beam infrared detectors includes using two infrared light emitting units for the light emitter and two light receiving units for the light receiver, with the units positioned spaced apart with a proper distance. If only one of the two units should be interrupted by something, the light receiver does not function to turn on a lamp or an alarm so as to prevent the light detector from functioning as a result of interruption caused by small things such as falling leaves, insects, birds, etc. Only when the two lanes of the infrared light beam are at the same time interrupted, the light detector will operate to turn on a lamp or an alarm.

Though the conventional infrared detectors can attain the purpose of using a double-lane infrared light beam for detecting intrusion, they are quite unsafe in practical use. FIG. 1 shows how the conventional infrared detector functions, with the conventional infrared detector including double-lane infrared light emitting units 1A and 1B of a light emitter 1 giving out two lanes of an infrared light beam, and including two light receiving units 2A and 2B receiving the infrared light beam coming from the light emitting units 1A and 1B. However, the conventional infrared detector of FIGS. 1 and 2 has the following disadvantages.

1. As to its effect: If a person wants to disable the conventional infrared detector, he can easily do it by using another light emitter 3 of the same source or a different source. The other light emitter 3 can be utilized to give out a double-lane infrared light beam from its two light emitting units 3A and 3B at a shorter distance than that between the original light emitter 1 and the original light receiver 2. As shown in FIG. 1, the other light emitter 3 can be oriented with only one of the two lanes of the light beam of the two emitting units 3A or 3B received by one of the light receiving units 2A or 2B, or as shown in FIG. 2, can be oriented with the two lanes of the light beam given out by the two emitting units 3A and 3B both received by the two light receiving units 2A and 2B. In either case, the effective distance of the infrared detector may become only the distance represented by L in FIGS. 1 and 2. The distance represented by L1 in FIGS. 1 and 2 between the light emitting units 1A and 1B and 3A and 3B loses its protective effect to permit a thief to pass across the light beam between the light emitter 1 and the light receiver 2 without triggering the light receiver 2 to function to turn on a lamp or an alarm. In other words, the conventional infrared detector is nominal and unsubstantial, being prone to be disabled by another infrared light emitter 3.

2. As to difficulty: Even if a would-be thief can not make out which is the light receiver 2, the would-be thief can use two sets of the other light emitters 3 to emit infrared light beams to both the light emitter 1 and the light receiver 2 thereby making the light receiver 2 to lose function so as to allow unauthorized access.

3. For keeping secret: The information used between the light emitter 1 and the light receiver 2 of the conventional infrared detector is a constant single code, nearly impossible to keep secret.

4. As to security: The conventional infrared detector cannot maintain protection against illegal use of other infrared emitters, and thus is not safe to use.

SUMMARY OF THE INVENTION

The purpose of the invention is to offer an infrared detector, improved to have function and protection against illegal measures of disabling by other infrared emitters and completely protected against intentional decoding by thieves.

The infrared detector of the present invention has a light emitter provided with plural infrared light emitting units separately emitting an infrared light beam. A circuit electronically connects the light emitter with a CPU programmed encoder and a power amplifying controller. The CPU programmed encoder calculates, processes and produces special codes to be controlled by the power amplifying controller. The special codes are fed to the infrared light emitting units of the light emitter, which focuses the infrared light beam and then projects it to a far-away light receiver. The light receiver receives the infrared light beam coming from the light emitter and feeds it to a signal amplifier connected to a CPU programmed comparing decoder and an output controller. Other, different codes used by a thief cannot disable any one of the light-receiving units of the light receiver in the infrared detector.

BRIEF DESCRIPTION OF DRAWINGS

This invention will be understood better by referring to the accompanying drawings, wherein.

DETAILED DESCRIPTION OF THE PREFERRED EMBODIMENT

Figure 2:
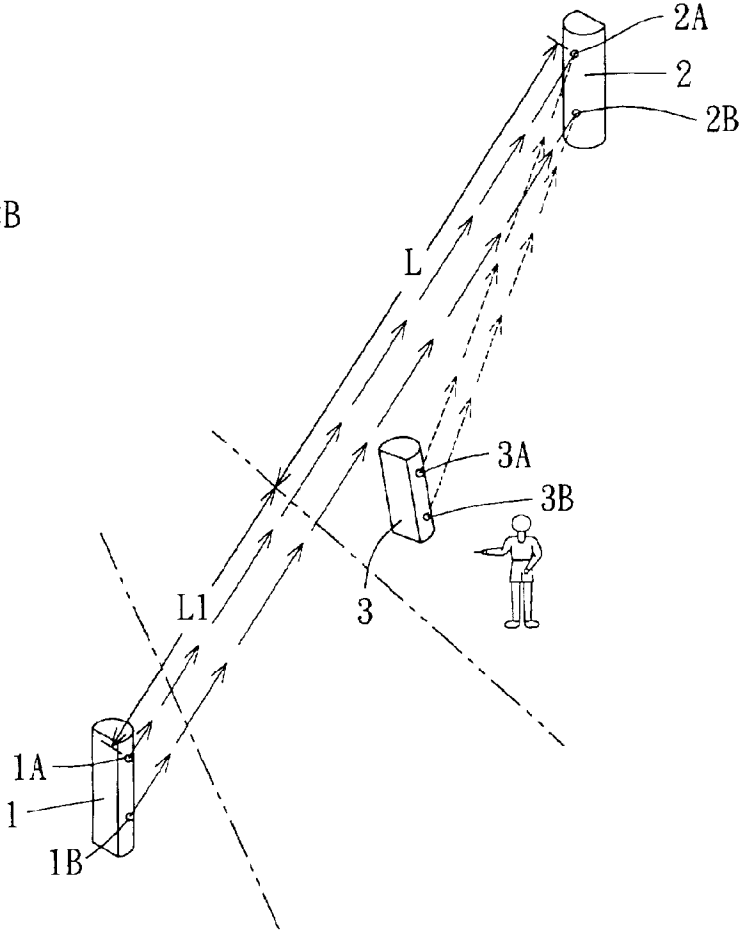
FIG. 2 (PRIOR ART)
FIG. 2 is another diagram of the conventional infrared detector being disabled by an infrared light beam emitted by another infrared light emitter.
Figure 1:
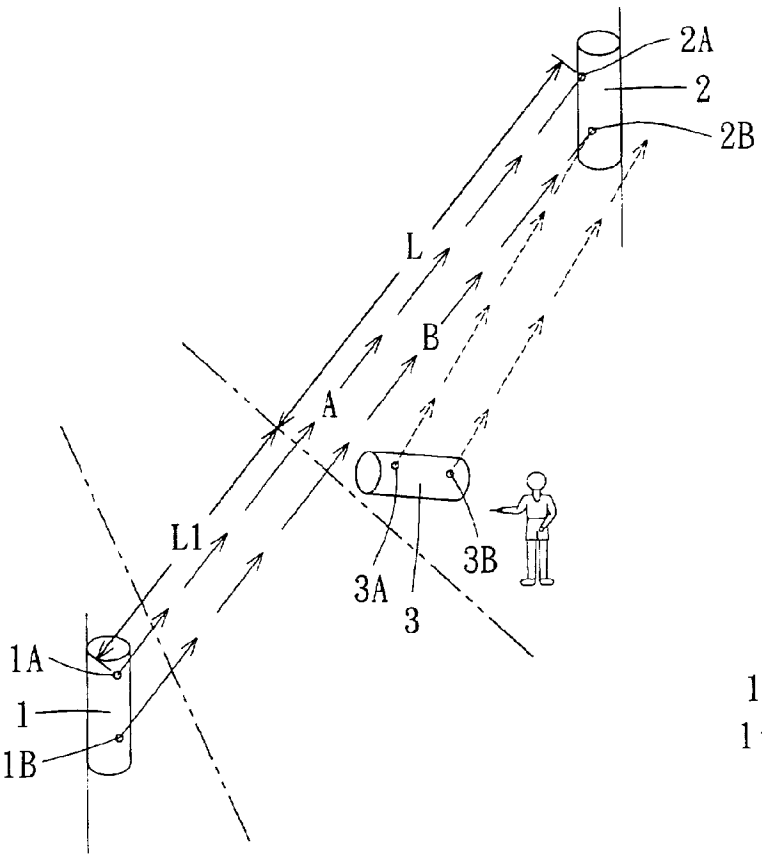
FIG. 1 (PRIOR ART)
FIG. 1 is a diagram of a conventional infrared detector being decoded by another infrared light emitter.
Figure 3:
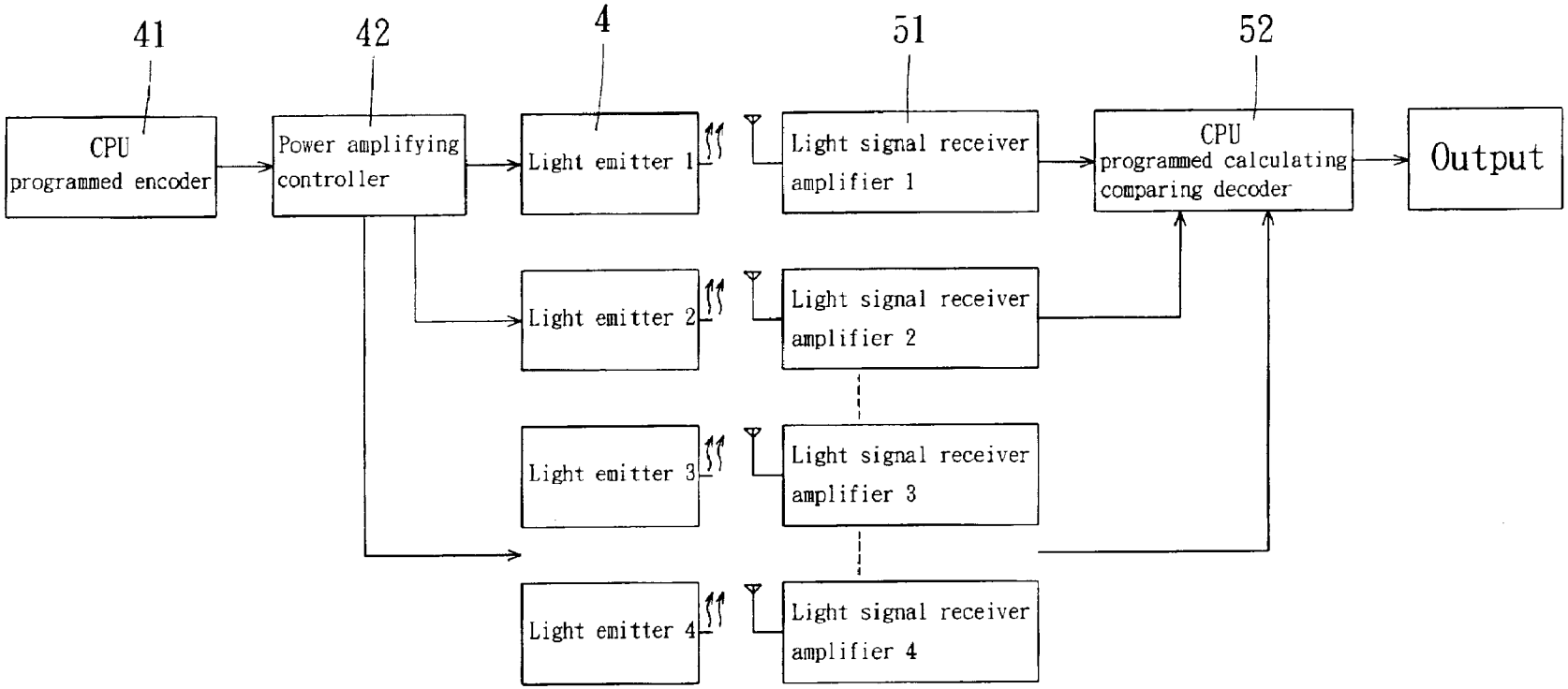
FIG. 3 is a block diagram of a preferred embodiment of an infrared detector of the present invention.
Figure 4:
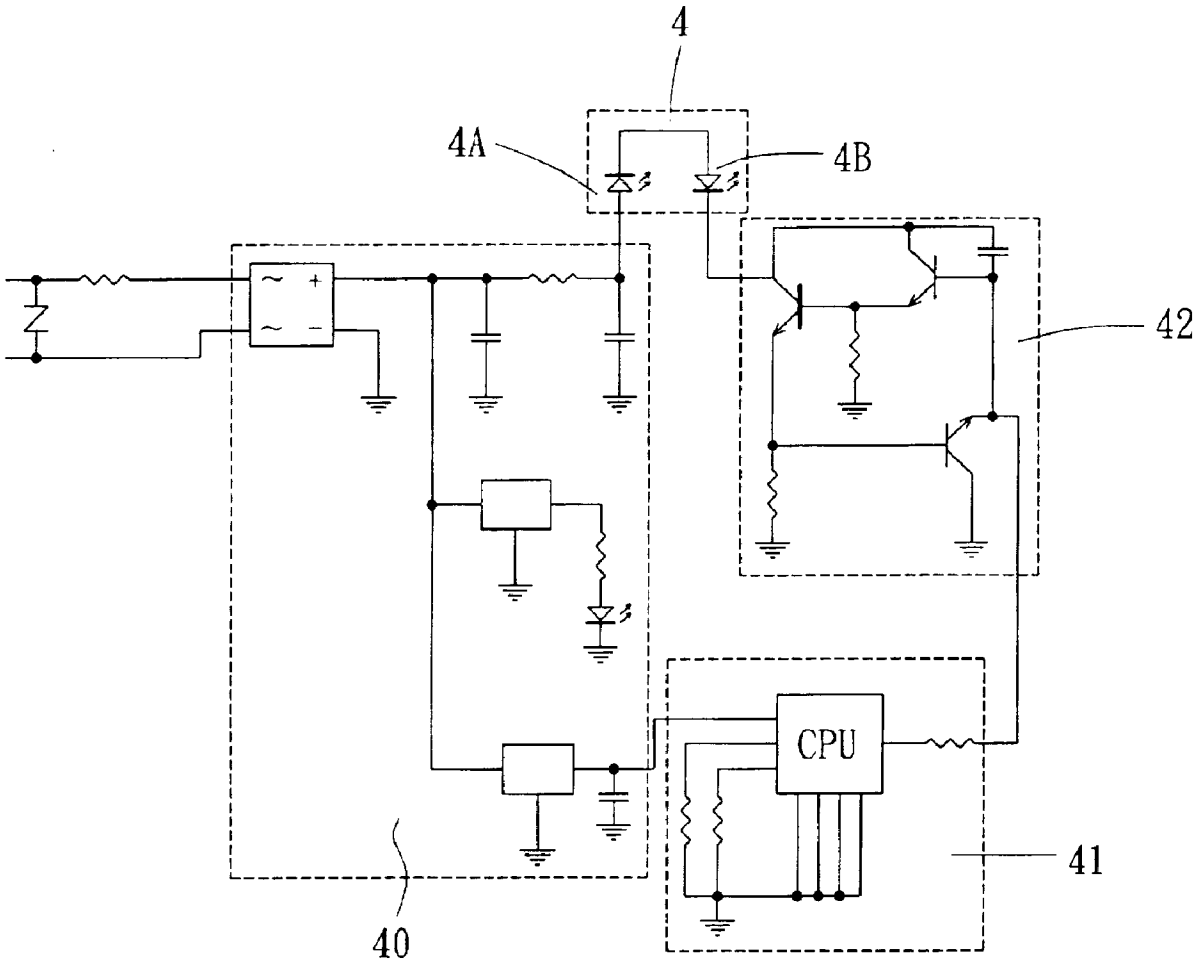
FIG. 4 is a diagram of an electronic circuit for a light emitter of the present invention; and, FIG. 5 is a diagram of an electronic circuit for a light receiver of the present invention.
Figure 5:
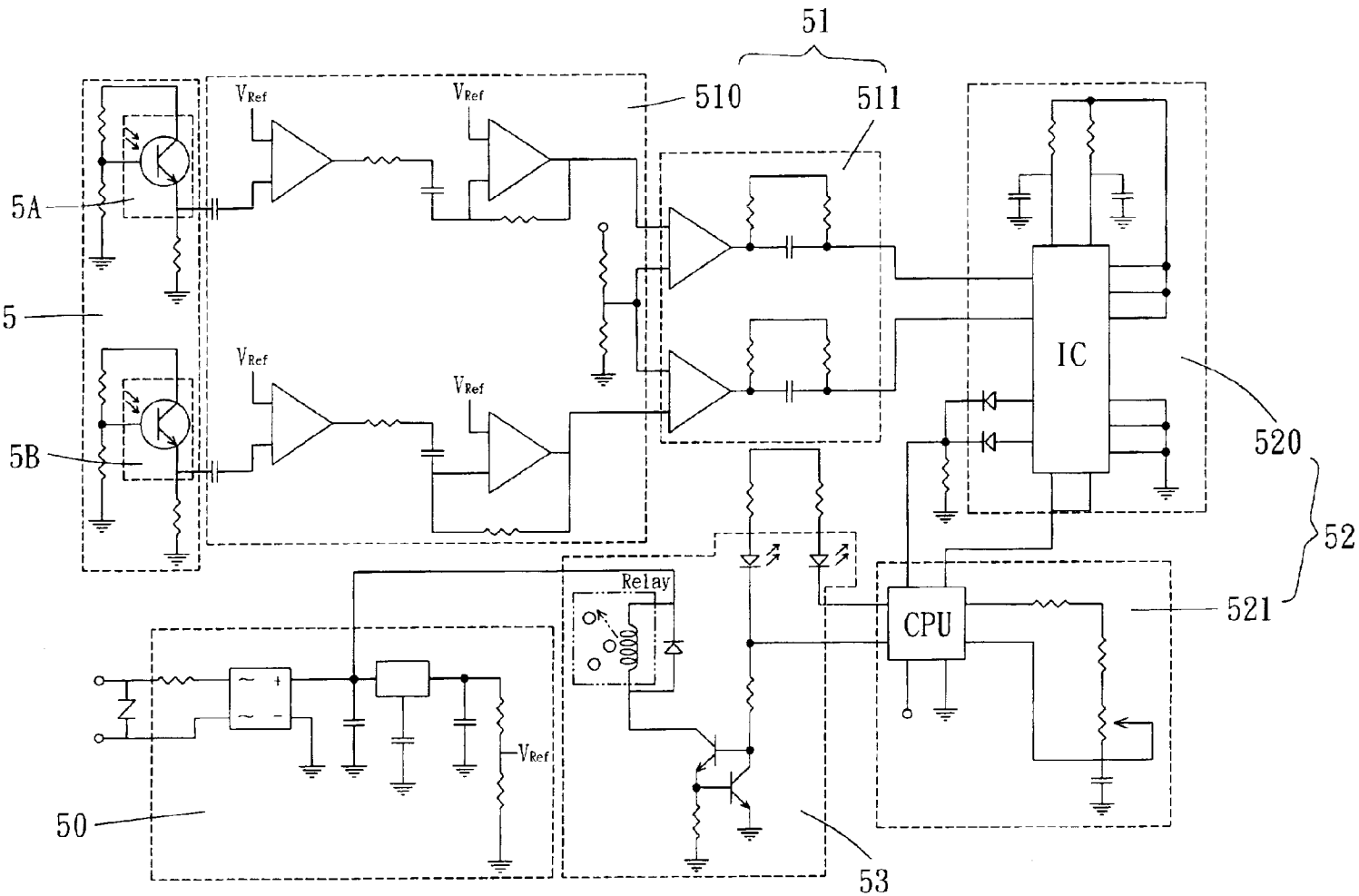

A preferred embodiment of an infrared detector of the present invention, as shown in FIGS. 3–5, includes a light emitter 4 including two, double-lane infrared light emitting units 4A and 4B. A circuit connects an electronic circuit 40 of the light emitter 4, a CPU programmed encoder 41, and a power amplifying controller 42. The infrared detector of the present invention also includes a light receiver 5 including two, double-lane infrared light receiving units 5A and 5B. A circuit connects an electronic circuit 50 of the light receiver 5, a signal amplifier 51, a CPU programmed decoder 52, and an output controller 53.

A special code is produced by the CPU programmed encoder 41, and the special code is not to be repeated. The special code is mixed with an irregular random number for preventing the special code from being decoded. The signal controlled by the special code added with the irregular random number is produced by the CPU programmed encoder 41 and then amplified by the power amplifying controller 42. The light emitting units 4A and 4B of the light emitter 4 focuses and projects the infrared light beam containing the code controlled signal to the far-away light receiver 5.

The light receiver 5 receives the infrared light beam coming from the light emitter 4 and feeds it to the signal amplifier 51. The signal amplifier 51 includes a small signal amplifier 510 and a wave rectifier 511. The small signal amplifier 510 amplifies the received signal and, through the wave rectifier 511, transmits the received signal to the CPU programmed decoder 52. The CPU programmed decoder 52 includes a comparing controller 520 and a CPU decoder 521. The CPU decoder 521 compares the received signal with a single code preset therein to carry out a proper measure.

As each infrared light receiving unit 5A and 5B of the light receiver 5 is designed as an independent calculating element, each infrared signal with the special code of the light emitter 4 received by the infrared receiving unit 5A or 5B is calculated separately by the CPU programmed decoder 52 and then compared separately, i. e. each lane infrared light beam is separately calculated and compared for decoding. Therefore, even if one of the infrared light receiving 5A or 5B produces an unexpected condition, the other infrared light receiving unit 5A or 5B cannot be affected in its discerning and calculating, thus, acquiring an effective and sufficient security defense.

It is quite clear that in practical use, the infrared detector of the present invention cannot be decoded or disabled by a person with illegal intention by projecting infrared light to one of the light receiving units of the light receiver of the present invention. It is impossible for the infrared light receiving unit of the present invention to be triggered to function by an infrared light containing an unauthorized code or a different code. Thus, the output controller 53 in line with an appliance such as a threatening lamp or alarm will not be automatically triggered to turn on. So, the infrared detector of the present invention has a complete security defense and is an improvement over the traditional infrared detector having its susceptible weakness of decoding or disabling.

Further, one worthy point to be noted in the present invention is that the number of lanes of the infrared beam is not limited to double-lane, but single-lane, three-lane or multi-lane can be applied. In addition, the CPU programmed encoder 41 can match with plural light emitters 4, as shown in FIG. 3.

While the preferred embodiment has been described above, it will be recognized and understood that various modifications may be made therein and the appended claims are intended to cover all such modifications that may fall within the spirit and scope of the invention.

What is claimed is:

1. A infrared detector comprising:

a light emitter having one or more infrared light emitting units and a circuit connecting said light emitter electronically with a CPU programmed encoder and a power amplifying controller, said CPU programmed encoder performing calculation and processing for producing a special coded signal, said special coded signal being emitted out with an infrared light beam of said infrared light emitting units to a light receiver positioned far away from said light emitter;

said light receiver having one or more infrared light receiving units for receiving the infrared light beam with the specially coded signal coming from said infrared light emitting units of said light emitter, an electronic circuit connecting electronically said light receiver with a signal amplifier, a CPU programmed decoder for calculation and comparing, and an output controller, each infrared light receiving unit of said light receiver independently receiving the infrared light beam with the special coded signal to be simultaneously separately transmitted to said signal amplifier for amplifying and to said CPU programmed decoder for calculating and comparing and automatically controlled by said output controller.

2. The infrared detector as claimed in claim 1, wherein said signal amplifier consists of a small signal amplifier and a wave rectifier.

3. The infrared detector as claimed in claim 1, wherein said CPU programmed decoder consists of a compare controller and a CPU decoder.

* * * * *